US008126342B2

(12) United States Patent
Gibson et al.

(10) Patent No.: US 8,126,342 B2
(45) Date of Patent: Feb. 28, 2012

(54) SYSTEM FOR TAILORING A TRANSFER NIP ELECTRIC FIELD FOR ENHANCED TONER TRANSFER IN DIVERSE ENVIRONMENTS

(75) Inventors: Nicholas Fenley Gibson, Lexington, KY (US); Brandon Alden Kemp, Lexington, KY (US); Brad Edward Mattingly, Lexington, KY (US); Michael Todd Phillips, Frankfort, KY (US); Peter Brown Pickett, Lexington, KY (US); Gregory Lawrence Ream, Lexington, KY (US); Christopher Michael Smith, Lexington, KY (US); Julie Ann Gordon Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 510 days.

(21) Appl. No.: 12/329,752

(22) Filed: Dec. 8, 2008

(65) Prior Publication Data

US 2010/0142981 A1 Jun. 10, 2010

(51) Int. Cl.
*G03G 15/00* (2006.01)
*G03G 15/20* (2006.01)
*G03G 21/20* (2006.01)

(52) U.S. Cl. ..... 399/44; 399/94; 399/97; 399/308; 399/314

(58) Field of Classification Search ..... 399/44, 399/121, 314
See application file for complete search history.

(56) References Cited

U.S. PATENT DOCUMENTS

| | | | | |
|---|---|---|---|---|
| 4,055,380 | A | 10/1977 | Borostyan | |
| 4,338,017 | A | 7/1982 | Nishikawa | |
| 5,198,864 | A | 3/1993 | Fletcher | |
| 5,452,063 | A | 9/1995 | Fletcher | |
| 5,742,888 | A * | 4/1998 | Fuchiwaki et al. | 399/308 |
| 5,873,015 | A * | 2/1999 | Christy | 399/296 |
| 5,897,247 | A * | 4/1999 | Tombs et al. | 399/308 |
| 6,363,228 | B1 | 3/2002 | Ream | |
| 6,516,179 | B1 * | 2/2003 | Sawai et al. | 399/388 |
| 7,020,432 | B2 * | 3/2006 | Omata et al. | 399/400 |
| 7,706,734 | B2 * | 4/2010 | Higashimura et al. | 399/316 |
| 2003/0113141 | A1 * | 6/2003 | Saito et al. | 399/302 |
| 2007/0217832 | A1 * | 9/2007 | Oyama et al. | 399/302 |
| 2008/0310893 | A1 * | 12/2008 | Adachi et al. | 399/314 |
| 2009/0010675 | A1 * | 1/2009 | Suzuki | 399/101 |
| 2009/0129831 | A1 * | 5/2009 | Sakashita et al. | 399/309 |
| 2009/0208257 | A1 * | 8/2009 | Matsumoto | 399/308 |

* cited by examiner

*Primary Examiner* — David Gray
*Assistant Examiner* — David Bolduc

(57) ABSTRACT

A system for tailoring a transfer nip electric field includes a transfer roll, a backup roll forming a transfer nip with the transfer roll, and a pre-nip roll positioned upstream from the transfer and backup rolls and the transfer nip such that a toner image-supporting transfer belt moving past the pre-nip, transfer and backup rolls separately makes contact with, wraps partially around, and rotates each of the rolls as a media sheet is fed into the transfer nip after first passing through a gap defined between the pre-nip and transfer rolls such that by presetting the position, geometry and charge of the pre-nip roll relative to the transfer and backup rolls and the transfer belt an electrical field at the transfer nip can be tailored for enhanced toner transfer from the transfer belt to the media sheet.

25 Claims, 5 Drawing Sheets

SYSTEM FOR TAILORING A TRANSFER NIP ELECTRIC FIELD FOR ENHANCED TONER TRANSFER IN DIVERSE ENVIRONMENTS

CROSS REFERENCES TO RELATED APPLICATIONS

None.

BACKGROUND

1. Field of the Invention

The present invention relates generally to electrophotographic (EP) imaging machines and, more particularly, to a system for tailoring a transfer nip electric field for enhanced toner transfer in diverse environments.

2. Description of the Related Art

Color EP imaging machines, such as color laser printers, typically utilize an intermediate transfer belt to accumulate a final output image from a plurality of individual images, known as separations or layers. The layers are placed onto the intermediate transfer belt in succession as the belt passes by a photoconductive (PC) drum associated with each of the different color, first transfer, stations. Once the intermediate transfer belt has traversed all of the PC drums the resulting, or final, output image will be transferred to a print medium, for instance a sheet of paper, at a second transfer station. The system of this color laser printer is known as a two transfer system.

Diverse environments create difficult situations for transferring toner in color laser printers. In cold/dry environments the media material and transfer components are highly resistive and it takes longer to build a transfer electric field. In hot/wet environments the media material and transfer components are very conductive and do not perform well the capacitive function needed to build a good transfer electric field.

In the two transfer system, toner is collected on the intermediate transfer belt after passing through the multiple, successive, first transfer stations. As toner passes through each of the successive stations, it gains charge from the post-nip breakdown which happens between the non-toned regions of the photoconductor (PC) drum, which have higher charge, and the belt. For this reason, toner placed on the belt in an upstream station gains more charge than toner placed on the belt in a downstream station. The inequality of the charge entering the second transfer nip contributes to difficulties in properly transferring both single layer, low charge toner and multi-layer, higher charged toner to the final media.

If the voltage or current range over which good transfer can occur (transfer window) is relatively large, then this difference in toner charge is not significant to transfer performance. The voltage or current is simply increased to the point where all toner can be successfully transferred. If, on the other hand, at the second transfer system there is difficulty creating a good electric charge field, a multitude of defects can result which cannot be adequately compensated for by simply increasing the voltage or current.

The most common defect caused by this problem is a washing out of the lowest charge single layer toner, normally the black toner, due to Paschen breakdown. The most common solution to this problem is to put other toner layers under the black to artificially both darken it due to the additional toner and modify the electric field at which it will transfer correctly because the added toner is higher in charge. While this solution is effective in creating good quality prints in difficult environments, it has some significant disadvantages.

The most significant disadvantage from a print quality point of view is that it does not address other occurrences of poor transfer caused by the extreme environment that shows up in the other colors.

The under-laid toner also reduces color cartridge yield, the number of printed sheets a cartridge can be expected to deliver under normal printing. Under-laying black toner also requires very good registration and color linearization as well as requiring color printing at all times which can increase wear on the whole printer. While under-laying black toner with process black is a good solution to get very high quality prints in certain circumstances, it is not the best option to employ at high temperature and humidity.

Several mechanisms are at work creating transfer problems in hot wet environments. The first of these is that sheets of paper have a variety of moisture acclimation levels. Very saturated paper is extremely conductive and can conduct current laterally within the paper itself. Lateral conduction of current can be a problem both for two transfer and single transfer systems when the current flow is significant as compared to the current required to transfer toner to the print medium.

When paper conducts current in the process direction it can cause loss of electric field by draining current to other components at other potentials (e.g. at ground potential) and it can cause non-uniform, pattern-dependent transfer. The circuit model of FIG. 1 demonstrates how this can happen. If the resistivity of the paper, represented by the resistors $R_p$, $R_{process}$ and $R_{lateral}$ is large, then current will travel down through the two parallel stacks of toner without much regard for the resistance and charge encountered in the toner. Very little current will go off to the sides because side paths are higher in resistance. However, if paper resistance is smaller, then the current will divide and some will cross over to go down the path of less resistance. This would means that lower charged thinner layers of toner would receive more current and thicker, higher charge layers of toner would receive less. The result of this is to decrease the voltage/current at which the thinner, lower charge layers come into and go out of the transfer window, and increase the voltage/current at which thicker, higher charged layer come into and go out of the transfer window. In situations where overlap of these two windows was already difficult, this aggravates the problem.

For transfer systems at hot/wet environments, more conductive paper also means increased charge migration from the transfer member side of the paper to the toner side of the paper. Charge on the surface of the paper can either initiate Paschen Breakdown (a voltage at which the insulation of air breaks down and an avalanche condition ensues allowing flow of ions) or, just as likely, discharge toner trying to transfer. Either occurrence produces areas of poor transfer efficiency because of the neutral and wrong sign toner created at the nip entrance. Solutions to address this problem have the undesirable result of hurting performance in cold/dry environments. In cold/dry environments rolls and paper require long nip time and large nips to enable formation of good transfer electric fields. In hot/wet environments where everything is more conductive, large nips increase current migration which leads to single-layer toner wash out.

Extreme current migration can also lead to non-uniform transfer of half tones and solids giving a mottled or "crunchy" look. A mottled toner defect caused by this problem will be referred to as "crunchy" defect. A transfer geometry that brings nips together as electric fields build up can reduce current migration, but low resistivity components allow the system to more rapidly go into pre-nip over-transfer, thus creating small transfer windows. In cold and dry environments, these types of nip geometries make building large charge fields difficult without pre-nip Paschen Breakdown.

Thus, there is still a need for an innovation that will deal satisfactorily with inequality of the charged layers of toner entering a transfer nip charge field in diverse environments.

SUMMARY OF THE INVENTION

The present invention meets this need by providing an innovation that enables a charge field to be tailored to meet the needs of the diverse environments. Previous efforts have attempted to achieve a similar goal by using complex mechanical devices that are too expensive and unreliable to be commercially viable. The innovation of the present invention is elegant in its simplicity and its effectiveness. The innovation involves incorporation of a pre-nip roll touching a low surface resistivity transfer belt biased to reduce field strength entering a transfer nip. The field strength can be increased by placing the pre-nip roll at zero potential as compared to the backup roll. Also, isolating conductive paper from grounding paths improves performance in diverse environments of temperature and humidity.

Accordingly, in an aspect of the present invention, a system for tailoring a transfer nip electric field for enhanced toner transfer in diverse environments includes a rotatable transfer roll having a first potential, a rotatable backup roll having a second potential and forming a transfer nip between the rolls as the rolls counter-rotate relative to one another, and a rotatable pre-nip roll having a third potential and being positioned upstream from the transfer and backup rolls and the transfer nip. In this way a toner image-supporting transfer belt moving past the pre-nip, transfer and backup rolls separately makes contact with, wraps partially around, and rotates each of the pre-nip, transfer and backup rolls as a media sheet is fed into the transfer nip after first passing through a gap defined between the pre-nip roll and the transfer roll. By presetting the position, geometry and charge of the pre-nip roll relative to the transfer and backup rolls and the transfer belt a electric field at the transfer nip can be tailored for enhanced toner transfer from the transfer belt to the media sheet in diverse environments.

In another aspect of the present invention, a system for tailoring a second transfer nip electric field for enhanced toner transfer in diverse environments includes a plurality of image-forming first transfer stations, a second transfer station having a second transfer nip, and an endless transfer belt transported in an endless path passing, first, through a plurality of first transfer nips at the first transfer stations where toner forming an image is deposited on the transfer belt and, second, into and through the second transfer nip of the second transfer station where the toner is transferred from the transfer belt onto a media sheet. The second transfer station includes a rotatable transfer roll having a first potential, a rotatable backup roll having a second potential and forming the second transfer nip between the rolls as the rolls counter-rotate relative to one another, and a rotatable pre-nip roll having a third potential and being positioned upstream from the transfer and backup rolls and the transfer nip such that the transfer belt moves past the pre-nip, transfer and backup rolls and separately makes contact with, wraps partially around, and rotates each of the pre-nip, transfer and backup rolls as a media sheet is fed into the transfer nip after first passing through a gap defined between the pre-nip roll and the transfer roll such that by presetting the position, geometry and potential of the pre-nip roll relative to the transfer and backup rolls an electric field at the second transfer nip can be tailored for enhanced toner transfer from the transfer belt to the media sheet in diverse environments.

BRIEF DESCRIPTION OF THE DRAWINGS

Figure 1:
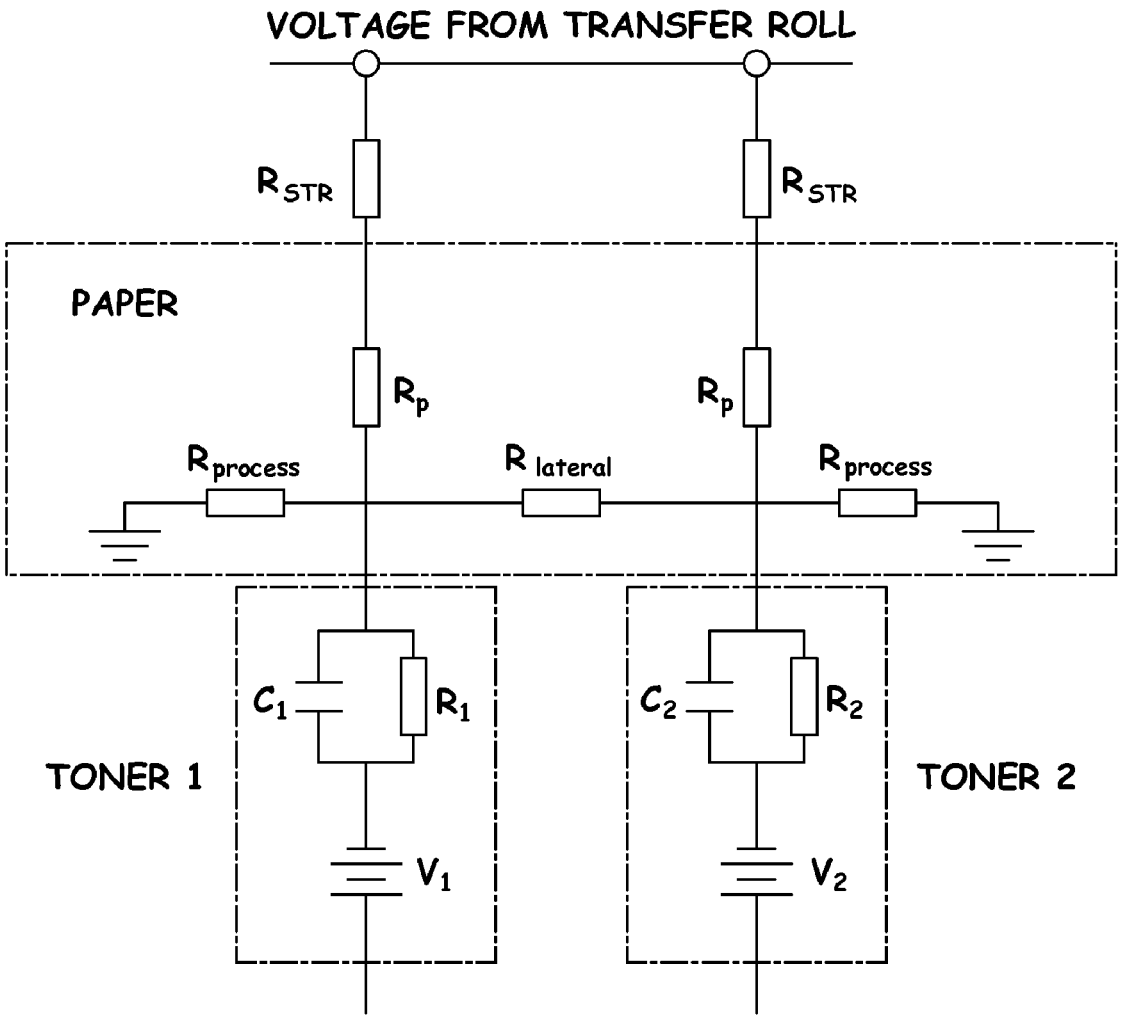

Having thus described the invention in general terms, reference will now be made to the accompanying drawings, which are not necessarily drawn to scale and in some instances portions may be exaggerated in order to emphasize features of the invention, and wherein:

FIG. 1 is an electrical circuit model of a piece of media and toner at a second transfer nip of a two transfer system.

Figure 2:
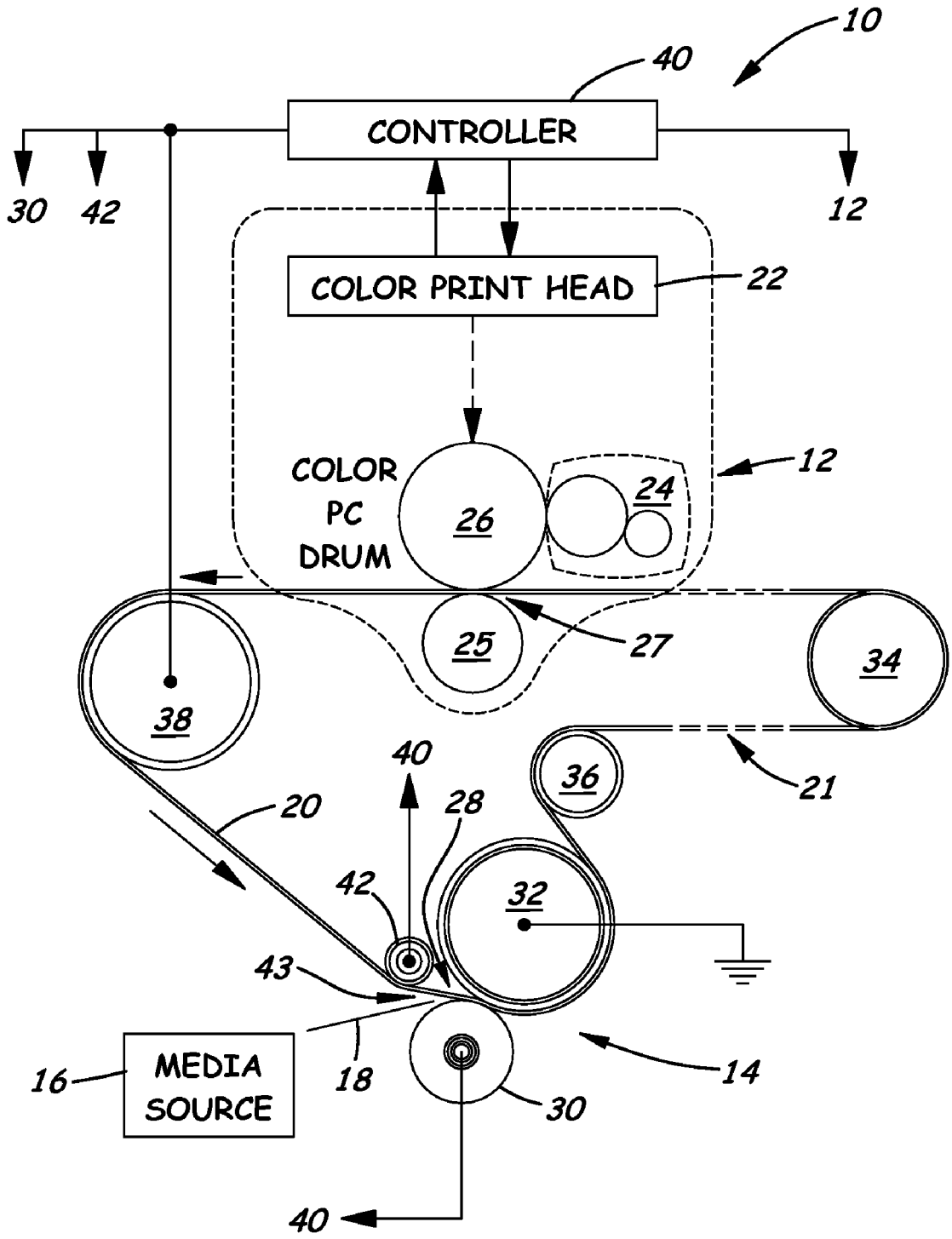

FIG. 2 is a simplified partial schematic representation of a color EP imaging machine to which is applied the system of the present invention.

Figure 3:
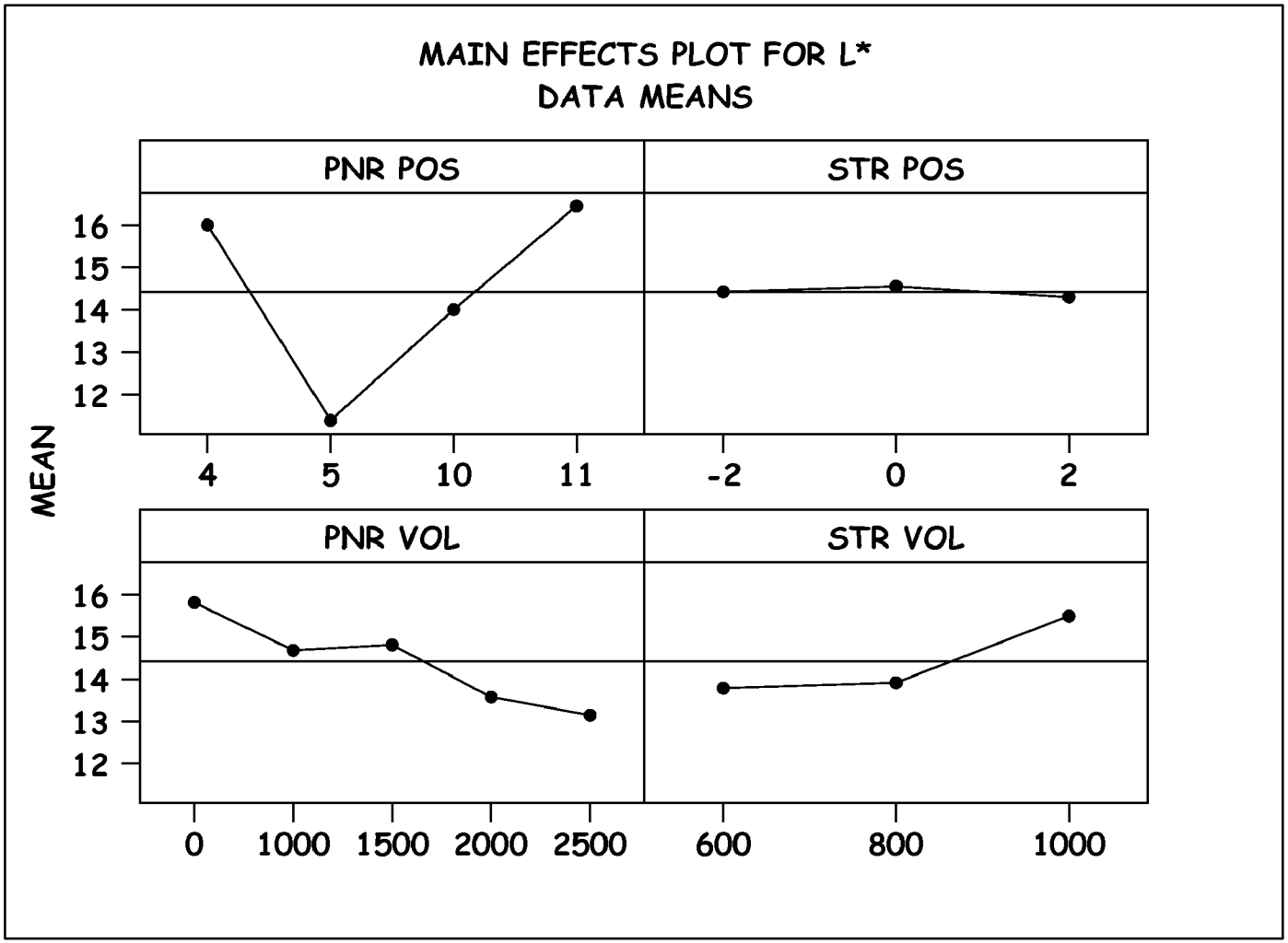

FIG. 3 is a graphical representation of effects of variable geometry/voltage arrangements on the L* defect.

Figure 4:
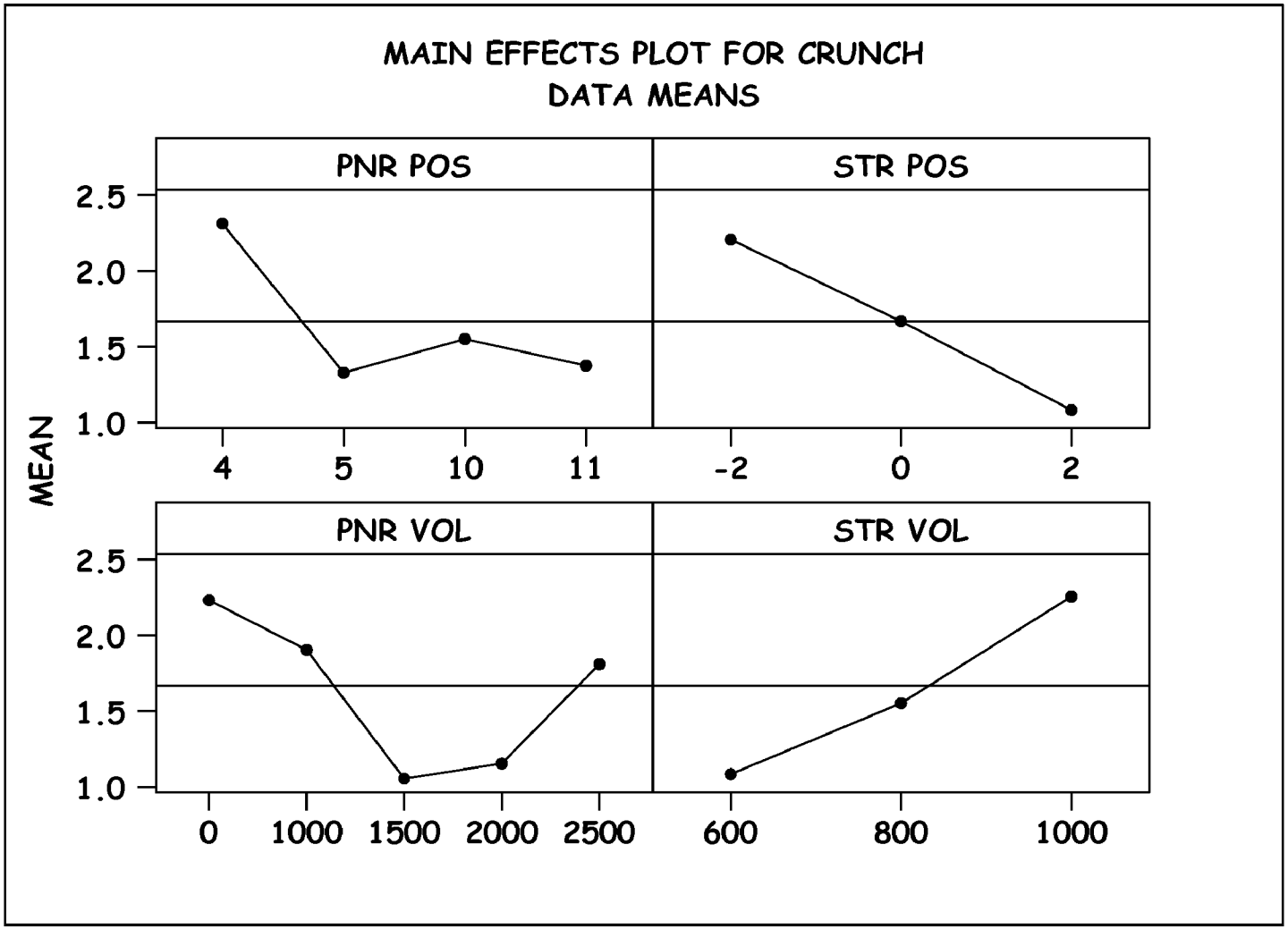

FIG. 4 is a graphical representation of effects of variable geometry/voltage arrangements on the crunchy defect.

Figure 5:
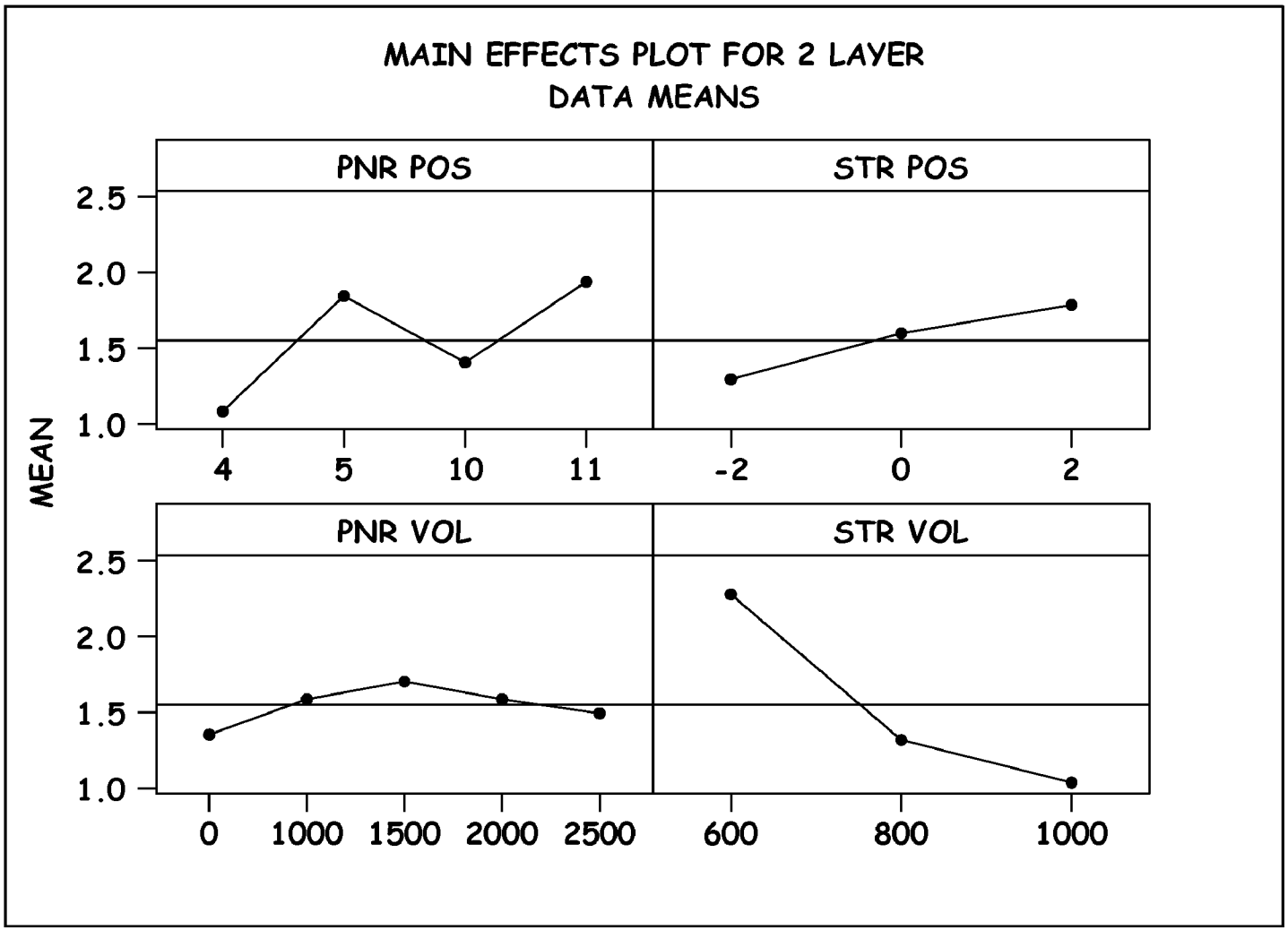

FIG. 5 is a graphical representation of effects of variable geometry/voltage arrangements on the two layer mottle defect.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 2, the color EP imaging machine 10 to which is applied the system of the present invention is a two transfer system. The imaging machine 10 includes, in part, a plurality of first transfer, color image forming, stations 12 (only one being shown), a second transfer station 14, a media source 16 for feeding one at a time a media sheet 18, of paper for instance, to the second transfer station 14, and an intermediate transfer belt 20 arranged to be moved along an endless path 21 which passes through the first and second stations 12, 14. By way of example, the color image forming stations 12 may provide respectively image layers having the colors, yellow (Y), cyan (C), magenta (M) and black (K). Each of the color image forming stations 12 includes a print head 22, a developer assembly 24, a first transfer roll 25, a PC drum 26 and a first transfer nip 27 between the first transfer roll 25 and the PC drum 26. The print head 22 forms a latent image on the PC drum 26. Toner (not shown) is supplied to the PC drum 26 by the developer assembly 24 to produce a developed toned partial image, know as a color separation or layer, from the latent image on the PC drum 26.

The color partial image layer produced at each of the first transfer stations 12 is transferred to the intermediate transfer belt 20 such that a composite color image accumulates thereon and then is transferred to the print medium, the media sheet 18, at the second transfer station 14 at a second transfer nip 28 defined between a second transfer roll 30 and a backup roll 32 positioned at the second transfer station 14. Both the media sheet 18 and intermediate transfer belt 20 pass through the second transfer nip 28 in contact with one another to enable the transfer of the composite color image to the media sheet 18 from the belt 20. The transfer belt 20 wraps partially about each of the second transfer roll 30 and the backup roller 32 such that they are counter-rotated relative to one another by their respective contacts with the transfer belt 20. Also in FIG. 2, there is shown guide rollers 34, 36 located downstream of the second transfer station 14 and a drive roller 38 located upstream thereof. The imaging machine 10 also includes a suitable controller 40 that controls all operations.

In accordance with the system of the present invention, the second transfer station 14 also includes a pre-nip roll 42 located upstream of the second transfer nip 28 formed between the second transfer roll 30 and the backup roll 32. The pre-nip roll 42 is configured and positioned to control the entrance geometry, as seen in FIG. 2, of a gap 43 between the intermediate transfer belt 20 with toner (not shown) thereon and the media sheet 18 onto which the toner will be transferred, for tailoring the electric field of the second transfer nip 28 for enhanced toner transfer in diverse environments of temperature and humidity. When building an electric field for transfer, this entrance geometry allows the distance between the media sheet 18 and the belt 20 to be reduced prior to increasing the transfer electric field at the second transfer nip 28. This has the effect of restricting or postponing Paschen Breakdown to a position chosen to or within the second transfer nip, thereby increasing both the transfer window and the transfer efficiency in that window.

As shown in FIG. 2, the transfer belt 20 is moving counterclockwise as the media sheet 18 enters the second transfer nip 28 substantially horizontally between the pre-nip roll 42 and the second transfer roll 30, successively wrapping partially about and rotating with the rolls 30, 42. The second transfer roll 30 is powered with, for example, a positive voltage from the controller 40 while the backup roll 32 is a metal roll that is grounded. The pre-nip roll 42 controls the entrance angle of the belt 20 into the second transfer nip 28 and thereby controls the gap 43 as the electric field builds.

In accordance with the system of the present invention, it is contemplated that the material of the belt 20 is a polyimide, which demonstrates better cleaning and transfer properties than most other belt materials. Other belt materials will function, but have not demonstrated as good a total performance over useful life. The surface resistivity of the belt should be relatively low; preferably, 1E09 ohm-cm to 1E10 ohm-cm. This allows a controlled amount of current to move laterally down the belt and enables field manipulation with the pre-nip roll 42 as controlled by the controller 40.

The pre-nip roll 42 should be powered also with a positive voltage in hot/wet environments. This voltage will reduce the electric field between the pre-nip roll 42 and the second transfer roll 30 which will also reduce the current migration in any moist paper entering the second transfer nip 28. To further ensure good fields, the media sheet 18 of paper should be isolated from ground by a resistance of approximately 25 Mohms or higher, more specifically, approximately 100 Mohms or higher to prevent dissipation of the electric field through paper conduction. Optimum isolation resistance will be dependent on total system resistances and maximum transfer power required for supported media types. In cold/dry environments the geometry does not need to be modified because the needs of a larger nip are already met by the system. The voltage on the pre-nip roll 42 can be reduced to improve transfer at that environment without physically altering the second transfer nip 28.

Experimentation in geometry/voltage setup at second transfer station. With respect to relative geometry considerations, it is important to optimize the physical locations of the second transfer, backup and pre-nip rolls 30, 32, 42 relative to each other because they serve both mechanical and electrical functions in the second transfer nip 28. Experimentation was carried out to configure an ideal geometry/voltage setup at the second transfer station 14. Unique geometry considerations of the pre-nip roll 42 and the second transfer roll 30 were combined with controlled voltage settings to optimize the second transfer electric field to produce the best toner transfer from an EP belt 20 to a media sheet 18 of paper. Each variable configuration had a unique result on unwanted print defects.

Within the experimentation, three main print defects were being examined. The print defects that commonly occur within a 78° F. temperature and 80% relative humidity environment are known as crunch defect described earlier as a mottle effect from pixels of toner that do not transfer, two layer mottle defect which is the lack of complete transfer of multiple toner layers caused by too low a field, and L* (star) defect or measured opacity of solid black areas. Based on the results of the experimentation, these defects are affected differently from one other by the variable geometry/voltage arrangements. FIGS. 3-5 are graphical representations of the main effects of the variable geometry/voltage arrangements on these three main defects. In these figures, PNR stands for pre-nip roll, Pos stands for position, Vol stands for voltage, and STR stands for second transfer roll.

With reference to the graphical representation in FIG. 3, for the L*defect the conclusive main effects are voltage dependent. When pre-nip roll voltage was increased, it helped redirect a stronger electric field downstream into the post-nip region that improved transfer to the media sheet 18 of paper. In general, as voltage increased on the pre-nip, the L* defect values improved, as can be seen in FIG. 3. Depending on the distance from the pre-nip roll 42 to the backup roll 32, the magnitude of the voltage did vary. Issues will occur when voltage becomes too high. For the recommended geometry approximately 1700 volts above backup roll voltage provided enough of a field to improve L* defect values without causing additional transfer defects. When voltage was increased on the second transfer roll 30, poorer quality L* defect values were produced. Pertaining to second transfer voltage, there was a tradeoff for L* defect values and additional transfer issues such as the two layer mottle defect. As second transfer voltage decreased, L* defect values improved but two layer mottle defect transfer was affected negatively.

With reference to the graphical representation in FIG. 4, the crunch defect saw an improvement as pre-nip roll voltage increased. Unlike L* defect, the crunch defect is affected by the second transfer roll position. When the second transfer roll 30 was moved downstream, it resulted in a better transfer when dealing with crunch. However, in positions downstream, the wrap around the second transfer roll 30 is decreased directly affecting the nip width in which transfer occurs. The compromise position given optimizes both a reduction in the crunch defect and maximizes two layer mottle defect transfer.

With reference to the graphical representation in FIG. 5, the two layer transfer is mainly affected by the second transfer roll position and its voltage. Unlike crunch and L* defects, two layer mottle defect worsens as the second transfer roll 30 is moved downstream and improves as second transfer voltage increases, as seen in FIG. 5. Note that pre-nip roll voltage does not have as significant an effect on two layer transfer as it does for crunch and L* defects. Two layer mottle defect transfer is improved as entry angle of the paper sheet 18 into the second transfer nip 28 is decreased and as the electric field within the second transfer nip 28 is optimized.

Relationships emerging from experimentation. The optimum geometry comes from a compromise of the important factors impacting print quality. In a hot and humid environment, a setup combining voltage of the pre-nip roll 42 from approximately 1500 volts to 2000 volts above the backup roll voltage with roughly 800 volts above the back up roll voltage applied to the second transfer roll 30 yields the best compromise for this configuration. Regarding what variables directly affect each individual transfer defect, the variable, the electric field, affects the L* and crunch defects, but does not affect the two layer mottle defect. The variable, the physical geometry (which refers to paper entrance angle and nip geometry), does not affect the L* defect, but does affect the crunch and two layer mottle defects. For optimizing these different variables, the following relationships in geometry between the second transfer, backup and pre-nip rolls 30, 32, 42 as well as with the media sheet 18 at the second transfer station 14 emerged from the above-described experimentation:

(1) pre-nip roll 42 should be located as close as possible to the backup roll 32, without a danger of discharge from the difference between the potentials of these two rolls.

(2) pre-nip roll 42 should be located in such a way as to reduce an angle between the transfer belt 20 and the incoming media sheet 18 of paper, preferably without taking this distance all the way to zero until just before the second transfer nip 28. This shallow angle reduces the gap 43 between the transfer belt 20 and media sheet 18 as field increases and therefore postpones Paschen Breakdown to a higher voltage level.

(3) second transfer roll 30 should be in contact with the transfer belt 20 and opposing the backup roll 32, but off center relative to a vertical reference line through the axis of the backup roll 32 in such a way as to allow for pre-wrapping of the transfer belt 20 partially around the second transfer roll 30. This partial pre-wrap combined with the lead-in of the transfer belt 20 by the pre-nip roll 42 to the incoming sheet 18 gives a large effective second transfer nip 28, important at cold/dry environments.

The following table gives the resultant diameters and center locations of the geometry that is optimum for the system of the present invention:

| | dimensions in mm | |
|---|---|---|
| Assume the center of backup roll 32 is at (0, 0) | x | y |
| center of second transfer roll 30 (nominal) | −12.43 | −22.04 |
| center of pre-nip roll 42 (nominal) | −20.17 | −6.03 |
| backup roll 32 to pre-nip roll 42 gap | 1.2 | |
| transfer roll 30 to pre-nip roll 42 gap | 4.33 | |
| tangential distance pre-nip roll 42 to backup roll 32 | 8 | |
| diameter of backup roll 32 | 32 | |
| diameter of second transfer roll 30 | 19 | |
| diameter of pre-nip roll 42 | 8 | |

Results of the experimentation. A metric was created to measure the combination of wash-out from Paschen Breakdown and discharge of toner from charge migration (crunch). This metric looked at the L* defect of single layer black toner and the "crunchiness" of black and color halftone coverage which was graded on a 1 (good) to 5 (poor) scale. The metric was the multiplication of the L* value and the relative crunch seen in the prints. Multiple configurations of nips were tested in a hot/wet environment of 78° F./80% RH with fully acclimated sheets of paper of smooth, plain and bond types. Transfer problems for hot/wet environments were most pronounced at slow speeds. The combination of materials, geometry and voltage decreased the quality metric from between approximately 100 and 150, depending on transfer voltage without the system of the present invention, to from approximately 20 to 50 for the same situation with the system of the present invention, the lower rating being preferred.

Parameters for tailoring the second transfer nip electric field for improved toner transfer in diverse environments of temperature and humidity. The pre-nip roll 42 is powered with a voltage of the same polarity as the second transfer roll 30 in hot/wet environments. This voltage reduces or neutralizes the field between the pre-nip roll 42 and the second transfer roll 30 which also reduces the current migration away from the second transfer nip 28 via moist sheet 18 of paper entering the second transfer nip 28. To further ensure good fields the sheet 18 of paper should be isolated from ground or other potentials by use of non-conductive paper feed elements or by grounding these components through high resistance. In cold/dry environment the geometry does not need to be modified because the needs of a larger nip are already met by the geometry of the pre-nip roll 42 and second transfer roll 30. The voltage on the pre-nip roll 42 can be reduced to improve transfer at that environment without physically altering the second transfer nip 28. In particular, toner scatter (or spew) may result in the pre-nip area if a large voltage is left on the pre-nip roll 42 at cold/dry environments—especially on dry paper such as that produced in a 2-sided printing operation.

Replacing a metal or other conductive backup roll 32 with a roll of the same resistivity as the second transfer roll can further reduce lateral conduction in hot/wet environments while still allowing for good charge fields at cold/dry environments. Similarly, replacing standard black toner with a toner that gets its black color from some carbon black but primarily from non-conductive pigments such as a composite of pigmented colors can also improve performance in hot/wet environments.

With respect to the presence of the pre-nip roll 42 with an applied voltage, this roll serves both a mechanical role to reduce pre-nip gap allowing higher transfer voltage in normal environments and as a field member in hot/humid environments. Suggested range of voltage is approximately 1000 to 3000 volts above the backup roll potential in hot/humid environments, with preferred voltage being about 1700 volts above the backup roll potential in hot/humid environments. Preferred voltage is equal to the back up roll potential in moderate or cold/dry environments. The type of environment can be directly translated to paper conductivity.

Use the voltage of the pre-nip roll 42 in combination with the length and resistivity of the transfer belt 20 to build a nullifying pre-nip electric charge field for hot/wet environments. This allows controlled contouring of the electric field without additional hardware. The suggested tangential distance from pre-nip roll 42 contact with the belt 20 to the second transfer nip 28 entrance is about 8 mm. The tangential distance range is about 16 mm to the closest position allowable by ESD constraints. ESD constraints will be dependent on voltage chosen and diameter of the rolls and the rules are well known in the art. The ideal surface resistivity on a polyimide transfer belt 20 would be about 1E09 ohm-cm, with an acceptable range from about 8E08 ohm-cm to 6E10 ohm-cm. Too low a resistivity is actually counter-productive and will increase crunch defect.

Positioning of the second transfer roll 30 will be such that the combination of angle from the pre-nip roll 42 geometry and the paper entrance angle will reduce the gap 43 prior to significant electric field increase. The voltage on the pre-nip roll 42 will prevent current migration in the paper while the gap is increasing. This will allow the same hot/wet environment to have the maximum transfer window for non-acclimated paper with the same transfer settings. The suggested pre-wrap of the transfer belt 20 onto the second transfer roll 30 is about 2 mm with an acceptable range being from approximately 0.5 to 4 mm. The suggested nip size is 2.5 mm with an acceptable range being from approximately 1 mm to 4.5 mm.

Electrical isolation of conductive paper from guides and transport mechanisms is to reduce electric field loss attributable to current conduction through the paper. The paper should be isolated from ground by a resistance of approximately 25 Mohms or higher, more specifically approximately 100 Mohms or higher depending on the comparative resistance and voltages of surrounding transfer system components. The potentials on the second transfer roll 30, the backup roll 32 and the pre-nip roll 42 may be chosen to keep media potential close to the ground.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A system for tailoring a transfer nip electric field for enhanced toner image transfer in diverse environments, comprising:

a rotatable transfer roll having a first potential;

a rotatable backup roll having a second potential and forming a transfer nip between said rolls as said rolls counter-rotate relative to one another; and a rotatable pre-nip roll having a third potential and being positioned upstream from said transfer and backup rolls and said transfer nip such that a toner image-supporting transfer belt moving past said pre-nip, transfer and backup rolls separately makes contact with, wraps partially around, and rotates each of said pre-nip, transfer and backup rolls as a media sheet is fed into said transfer nip after first passing through a gap defined between said pre-nip roll and said transfer roll such that by presetting the position, geometry and charge of said pre-nip roll relative to said transfer and backup rolls and the transfer belt an electric field at said transfer nip can be tailored for enhanced toner transfer from the transfer belt to the media sheet in diverse environments;

wherein in a relatively hot and humid environment, said first potential is approximately 800 volts above said second potential and said third potential is in a range of approximately 1500 volts to approximately 2000 volts above said second potential, and wherein said third potential is about zero volts above said second potential in a relatively cold and dry environment, the cold and dry environment being colder and dryer than the hot and humid environment.

2. The system of claim 1 wherein said second potential of said backup roll in the hot and humid environment is ground level.

3. The system of claim 1 further comprising media feed components for feeding media in proximity with said transfer roll, backup roll and pre-nip roll, wherein the media feed components are isolated from electrical ground by a resistance of at least 25 Mohms.

4. The system of claim 1 further comprising media feed components for feeding media in proximity with said transfer roll, backup roll and pre-nip roll, wherein the media feed components are isolated from electrical ground by a resistance of at least 10 Mohms.

5. The system of claim 1 wherein the potentials of the transfer roll, backup roll and pre-nip roll are chosen to keep a media potential close to ground.

6. The system of claim 1 wherein said transfer roll is in contact with said transfer belt and opposing said backup roll but off center relative to a vertical reference line through an axis of said backup roll in such a way as to allow for pre-wrapping said transfer belt partially around said transfer roll before said transfer belt engages said backup roll.

7. The system of claim 1 wherein said transfer belt has a pre-wrap on said transfer roll within a range being from approximately 0.5 to 4.0 mm.

8. The system of claim 1 wherein said transfer belt has a pre-wrap on said transfer roll of about 2.0 mm.

9. The system of claim 1 wherein said pre-nip roll is located in such a way as to reduce said gap to an angle formed between said transfer belt and incoming media sheet down to zero just before reaching said transfer nip.

10. The system of claim 1 wherein said transfer belt is composed of a polyimide material.

11. The system of claim 1 wherein said transfer belt has a surface resistivity from about 1E09 ohm-cm to 1E10 ohm-cm.

12. A system for tailoring a second transfer nip electric field at a second transfer station for enhanced toner transfer in diverse environments, comprising:

a plurality of image-forming first transfer stations;

a second transfer station having a second transfer nip; and an endless transfer belt transported in an endless path passing, first, through a plurality of first transfer nips at said first transfer stations where toner forming an image is deposited on the transfer belt and, second, into and through said second transfer nip of said second transfer station where the toner is transferred from said transfer belt onto a media sheet;

said second transfer station including a rotatable transfer roll having a first potential, a rotatable backup roll having a second potential and forming said second transfer nip between said rolls as said rolls counter-rotate relative to one another, and a rotatable pre-nip roll having a third potential and being positioned upstream from said transfer and backup rolls and said transfer nip such that said transfer belt moving past said pre-nip, transfer and backup rolls separately makes contact with, wraps partially around, and rotates with each of said pre-nip, transfer and backup rolls as a media sheet is fed into said second transfer nip after first passing through a gap defined between said pre-nip roll and said transfer roll such that by presetting the position, geometry and potential of said pre-nip roll relative to said transfer and backup rolls a voltage field at said second transfer nip can be tailored for enhanced toner transfer from the transfer belt to the media sheet in diverse environments;

wherein in a relatively hot and humid environment, said first potential is approximately 800 volts above said second potential and said third potential is in the range of approximately 1500 volts and approximately 2000 volts above said second potential, and wherein in a relatively cold and dry environment, said third potential is about zero volts above said second potential, the cold and dry environment being colder and dryer than the hot and humid environment.

13. The system of claim 12, wherein said second potential of said backup roll in the hot and humid environment is a ground potential.

14. The system of claim 13 further comprising components which feed the media sheet to said transfer roll, said backup roll and said pre-nip roll, the components being isolated from electrical ground by a resistance of at least 25 Mohms.

15. The system of claim 13 further comprising components which feed the media sheet to said transfer roll, said backup roll and said pre-nip roll, the components being isolated from electrical ground by a resistance of at least 100 Mohms.

16. The system of claim 12 wherein said transfer roll is in contact with said transfer belt and opposing said backup roll but off center relative to a vertical reference line through an axis of said backup roll in such a way as to allow for pre-wrapping said transfer belt partially around said transfer roll before said transfer belt engages said backup roll.

17. The system of claim 12 wherein said transfer belt has a pre-wrap on said transfer roll within a range being from approximately 0.5 to 4.0 mm.

18. The system of claim 12 wherein said transfer belt has a pre-wrap on said transfer roll of about 2.0 mm.

19. The system of claim 12 wherein said pre-nip roll is located in such a way as to reduce said gap to an angle formed between said transfer belt and incoming media sheet down to zero just before reaching said transfer nip.

20. The system of claim 12 wherein said transfer belt is composed of a polyimide material.

21. The system of claim 12 wherein said transfer belt has a surface resistivity from about 1E09 ohm-cm to 1E10 ohm-cm.

22. The system of claim 1 wherein said third potential of said pre-nip roll is adjusted based in part on paper conductivity.

23. The system of claim 1, wherein the hot and humid environment is at about 78 degrees F. and about 80 percent humidity.

24. The system of claim 12 wherein said third potential of said pre-nip roll is adjusted based in part on paper conductivity.

25. The system of claim 12, wherein the hot and humid environment is at about 78 degrees F. and about 80 percent humidity.

* * * * *